US006908423B2

(12) United States Patent
Hruschka et al.

(10) Patent No.: US 6,908,423 B2
(45) Date of Patent: Jun. 21, 2005

(54) SCREW FOR A SOLID-BOWL CENTRIFUGE AND A METHOD OF EXTRACTING OIL USING THE CENTRIFUGE

(75) Inventors: Steffen Hruschka, Oelde (DE); Roger Hülsmann, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 10/311,874

(22) PCT Filed: Oct. 18, 2001

(86) PCT No.: PCT/EP01/12069

§ 371 (c)(1),
(2), (4) Date: Dec. 20, 2002

(87) PCT Pub. No.: WO02/38278

PCT Pub. Date: May 16, 2002

(65) Prior Publication Data

US 2003/0129042 A1 Jul. 10, 2003

(30) Foreign Application Priority Data

Nov. 10, 2000 (DE) ..... 100 55 798

(51) Int. Cl.[7] ..... B04B 1/20
(52) U.S. Cl. ..... 494/37; 494/54; 494/901
(58) Field of Search ..... 494/50–55, 37, 494/901; 210/380.1, 380.3; 198/661–662, 664, 676; 366/319, 322

(56) References Cited

U.S. PATENT DOCUMENTS 2,862,658 A * 12/1958 Dahlgren ..... 494/901
4,617,010 A * 10/1986 Epper et al. ..... 494/52
5,037,373 A * 8/1991 Mozley ..... 494/55
5,222,935 A * 6/1993 Schlarb ..... 210/380.3
5,354,255 A * 10/1994 Shapiro ..... 494/53
5,656,180 A * 8/1997 Pieralisi ..... 494/53
6,004,255 A * 12/1999 Madsen ..... 494/54

FOREIGN PATENT DOCUMENTS

| | | | |
|---|---|---|---|
| DE | 4132 693 A1 | | 10/1991 |
| DE | 4132593 A1 | * | 4/1993 |
| EP | 258012 A2 | * | 3/1988 |
| EP | 557 758 | | 2/1993 |
| EP | 1364717 A2 | * | 5/2004 |
| JP | 57-194061 | * | 11/1982 |
| WO | WO 97/23295 | | 7/1997 |
| WO | 02/38278 A1 | * | 5/2004 |
| WO | 03/099975 A1 | * | 12/2004 |

* cited by examiner

*Primary Examiner*—Charles E. Cooley
(74) *Attorney, Agent, or Firm*—Barnes & Thornburg LLP

(57) ABSTRACT

A screw for a solid-bowl screw-type centrifuge, comprising: a screw body having a circumference, a cylindrical section and a conical section; at least one screw blade surrounding the screw body several times and forming several screw spirals; a delivery path for conveying material to be centrifuged formed between the screw spirals; blade segments arranged in the delivery path between adjacent screw spirals only in a portion of the cylindrical section; and recesses in the at least one screw blade, the recesses constructed only in a portion of the cylindrical section and constructed such that the material to be centrifuged can flow through between adjacent screw spirals. A method for extracting oil in a two- and three-phase separation process using the screw of the present invention.

39 Claims, 7 Drawing Sheets

SCREW FOR A SOLID-BOWL CENTRIFUGE AND A METHOD OF EXTRACTING OIL USING THE CENTRIFUGE

BACKGROUND AND SUMMARY OF THE INVENTION

The invention relates to a screw for a solid-bowl screw-type centrifuge and to a method of extracting oil by means of a solid-bowl screw-type centrifuge.

A method which has been particularly effective for the extraction of olive oil is known from European Patent Document EP 0 557 758. In this process, a two-phase separation is carried out in which the oil is separated directly from the solids/water mixture.

The efficiency of this known method is very good per se.

Nevertheless, it is desirable to lower the residual oil content in a rape in order to increase the economic efficiency of the oil extraction.

The present invention provides for, on the one hand, a screw for a solid-bowl screw-type centrifuge and a process for extracting oil from fruit or seed.

The present invention provides for a screw or kneading screw for a solid-bowl screw-type centrifuge which has at least one screw blade and at least one screw blade segment in a delivery path in sections or areas between adjacent screw spirals. In addition, the at least one screw blade is preferably provided with recesses which are constructed such that centrifuged material can flow through between adjacent screw spirals.

With respect to the method of separating or extracting oil, it was found to be particularly favorable for the oil, as a liquid phase, to be extracted directly in a two-phase separating process. The oil is extracted as a liquid or first phase from a second or mixed phase which may include a mixture of water and solids. Thus, seeds or reduced fruit, such as olives or avocados, are first guided into a solid-bowl screw-type centrifuge through a first portion of a separating zone having at least one screw blade with one or more screw spirals in a cylindrical section of the centrifuge. The at least one screw blade is preferably constructed without any recesses in a delivery path area between the screw spirals and, preferably, no blade segments are constructed in the delivery path. Subsequently, a passing takes place into a second portion of the separating zone in which recesses are constructed in the at least one screw blade, and blade segments are constructed the delivery path. Then the solids and the water are conveyed past a retarding plate or disk, which acts as a barrier to the oil, from the separating zone into a conically tapering section or dry zone of the screw and then out of the centrifuge. The oil is conveyed in an opposite direction out of the centrifuge.

Also, by use of the screw according to the present invention, a three-phase oil extraction process, which is still occasionally used, can be improved. In this case, oil is separated or extracted as a liquid or first phase, in a three-phase separating process, from a second phase comprising water and a third phase comprising solids. The process occurs as follows:

the reduced fruit, such as olives or avocados or seeds are first guided into a solid-bowl screw-type centrifuge through a first portion of a separating zone having at least one screw blade with one or more screw spirals in a cylindrical section of the centrifuge. The at least one screw blade is preferably constructed without recesses, and preferably with no blade segments constructed in the delivery path between the screw spirals, then, a passing takes place into a second portion of the separating zone, in which recesses are constructed in the at least one screw blade and blade segments are constructed in the delivery path, then the three phases, water, solids and oil are guided/delivered out of the centrifuge essentially separately. The water and oil may exit at different levels toward a cylindrical end of the centrifuge and the solids may exit toward a conical end of the centrifuge.

By use of the screw according to the present invention, the economic efficiency of the oil extraction can be increased considerably. In this regard, reference is particularly made to tests explained herein and whose results are shown in FIGS. 4 and 5. The screw of the present invention can also be retrofitted without any problem into existing centrifuges. The screw according to the present invention is particularly suitable for an application in a process for extracting oil from fruit and seeds and for a better draining of water and/or separating of oil from mashes of organic materials (such as seed mash, fruit flesh mash, animal tissue, such as fish, egg, fatty tissue cells).

According to the present invention, a combination of recesses and blade segments are provided. The blade segments and the recesses preferably are constructed such in the axial direction that the recesses each form ducts extending in the axial direction (and/or at an angle or in a zigzag-type manner with respect to the center axis y), in which ducts the blade segments stand.

Also according to the present invention, the blade segments and the recesses may be constructed only in the cylindrical section of the screw body and a retarding disk may be provided in the conical section of the screw, particularly in the two-phase separation.

According to the prior art, solid-bowl screw-type centrifuges are known, in which recesses are provided in the screw blade. For example, see German Patent Document DE 41 32 693 A1. However, according to the present invention, the simple providing of such recesses is not sufficient to obtain a significant increase in efficiency. On the contrary, an increase in efficiency can be achieved when, in addition to recesses, provided in a center of the delivery path between adjacent screw spirals, the blade segments are also constructed.

It is also known to construct blade-segment-type screw spirals, as is shown, for example, in International Patent Document WO 97/23295. Those blade segments extend into the conical section, which is not favorable. In addition, those blade segments are distributed on the circumference of the screw body over its entire area, which was also found to be not favorable. In addition, it is not that additional blade segments are set up in the delivery path between the screw spirals, but the blade segments themselves form the screw spirals. Also, by use of this prior art screw, no satisfactory economic efficiency can be achieved when extracting olive oil.

According to the present invention, the blade segments in the delivery path may be constructed such that they extend into an area where solids are present, such as a solids area. However, there is an exterior area of, for example, approximately 25 mm that is preferably not reached by the blade segments, because relatively completely de-oiled solids and permanently discharged solids are already present in this exterior area.

Measuring results indicate that the screw according to the present invention leaves approximately 1 to 1.5% less oil in a discharged solids sludge. During an olive oil extraction campaign, this corresponds to a financial savings of approximately DM 300,000.00 to 500,000.00 per centrifuge machine.

The screw of the present invention may operate in an area of moist orujo or rape, because in that area a special separation of oil can be achieved by means of the blade segments.

By use of the present invention, a solids mash can be fed into a bowl or drum preferably by way of a rectangular tube. The rectangular tube must be so long that the entering mass or mash to be centrifuged is charged or forced through an oil layer while being protected in order not to mix with the oil layer at a later time.

In a filled centrifuge machine, an oil separation area may occur rather close to the screw body, for instance, at a distance of approximately 10, 20 . . . , to 40 to 50 mm. Fresh oil, as a distinct phase, can generally be recognized approximately in the range of 20 to 30 mm outside or away from the screw body. A distinct separating line usually exists here. The range of the oil separation area may vary with different centrifuges.

Charged solids, as part of a fed suspension, will therefore fill the centrifuge to such an extent that the latter is filled to the oil separation area (approximately 10–50 mm outside the screw body) with solids suspensions. The reason is that, as a rule, only so little water is in the orujo or rape mass that no water or only an extremely small layer of free water is formed between the oil and the solids suspension. In this case, the solids are dryer on the outside than on the inside or, in other words, a fraction of dry substance on the drum side is much higher than a fraction of dry substance toward the interior.

In the area of the recesses and blade segments, the solids suspension, just like the oil and an emulsion situated in-between, experiences three axial speeds particularly in a kneading area of the blade segments, from the screw body to an outside radial end of the blade segment.

Thus, a normal axial speed exists in the area of residual wall pieces or sections of the screw spirals. In contrast, in the area of the recesses, the axial speed is essentially zero. However, the axial speed in the area of the actual blade segments in the delivery path may amount to five times the normal speed. As a result, an elastoviscous sludge is deformed, compressed and relaxed in a standing solids area adjacent a surface of the drum.

In the area of the leading blade segments, for example x+1, x+2, x+3, x+4, the solids are additionally axially compressed. In the area of the recesses, they are then relaxed. This has the effect of pressure increases and relaxations. A setting-free or separation of the oil essentially takes place in a relaxation area and the extraction of oil is therefore more effective than without such relaxation areas.

In a rearward area, the screw body preferably has a cylindrical section and, in its adjoining forward section, a section which tapers essentially conically in a uniform or non-uniform—for example, stepped manner. The recesses and blade segments are constructed only in the area of the cylindrical section.

In the cylindrical section, the screw body preferably first has at least one screw spiral which is constructed without recesses as well as without blade segments and which is followed by additional screw spirals which are provided with the recesses and blade segments.

It is also conceivable that optional oil drainage ducts are constructed preferably in the first screw spiral.

The recesses preferably have a residual section of the screw blade on the circumference of the screw body.

Relative to one or several screw spirals, the blade segments may be uniformly, or may be non-uniformly, distributed on the circumference of the screw body.

The area of the recesses may amount to approximately 25–60%, preferably approximately 40–50% of the screw spiral area.

The recesses in the screw blades may be constructed such that they radially project at least beyond the solids area (for example, 70–95%, preferably 70–100% of the screw blade height).

The height of the blade segments may be approximately 0–30% lower than the height of the screw blade.

The blade segments may be constructed as rectangular metal plates. Trapezoidal, rounded elements and/or elements shaped to be tapering or widening and extending from the screw body radially outward or to the outside are also conceivable.

Other aspects and novel features of the present invention will become apparent from the following detail description of the invention when considered in conjunction with the accompanying drawings.

DETAILED DESCRIPTION OF THE PREFERRED EMBODIMENTS

Figure 1:
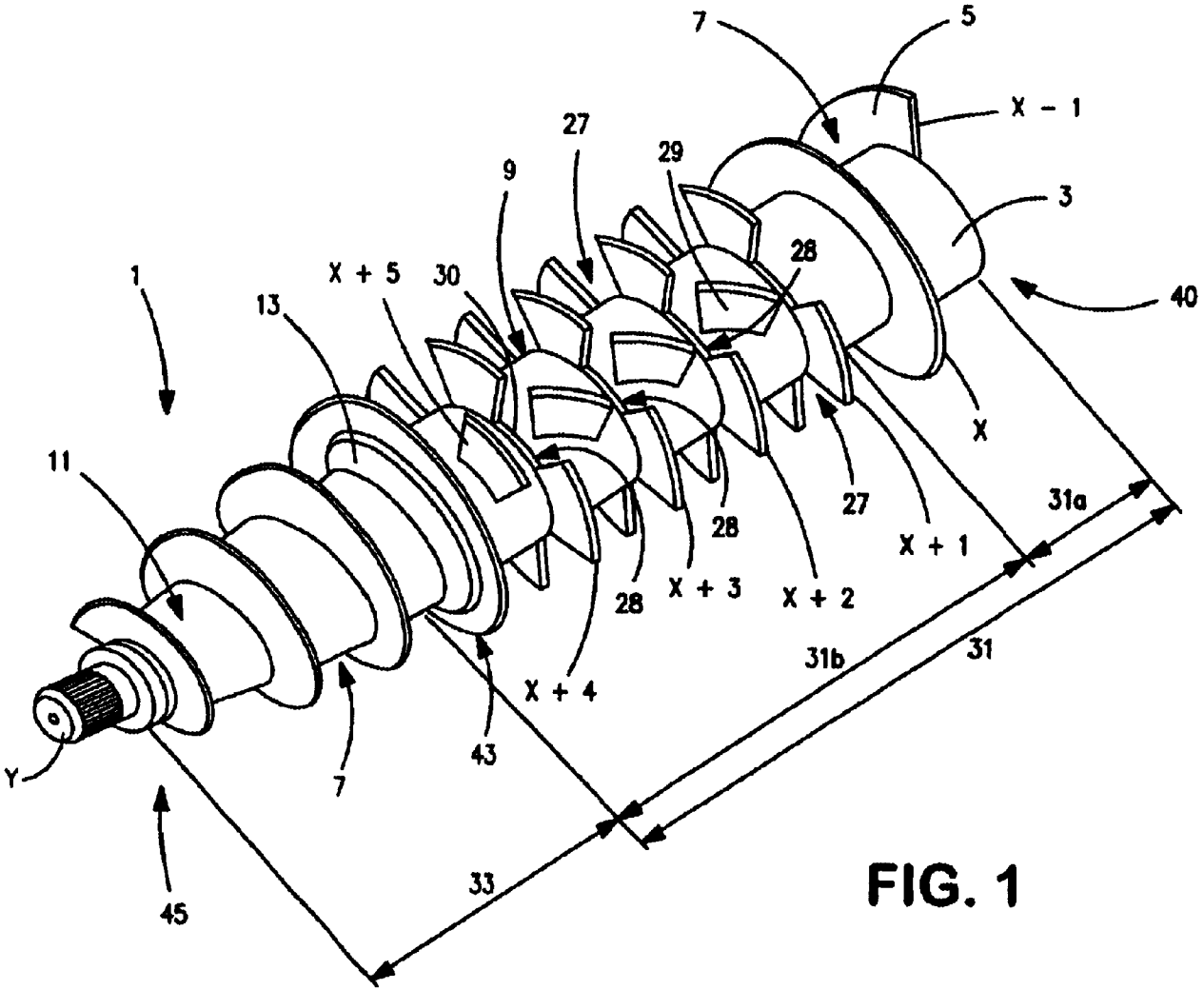
FIG. 1 is a perspective view of a screw, according to the present invention.

FIG. 1 illustrates a screw 1 for a solid-bowl screw-type centrifuge 50 (see FIG. 3), the screw 1 having a screw body 3 as well as, in this case, a screw blade 5 which surrounds the screw body 3 several times and forms several screw spirals (for example x, x+1, x+2, etc.).

A delivery path 7 for delivering/conveying a material to be centrifuged is formed between the screw spirals x, x+1, . . . .

In a rearward area 40 the screw body 3 has a cylindrical section 9 and, in an adjoining forward area 45, the screw body 3 has a dry zone 33 or conically tapering section 11 that is essentially conical, uniformly or non-uniformly.

Figure 3:
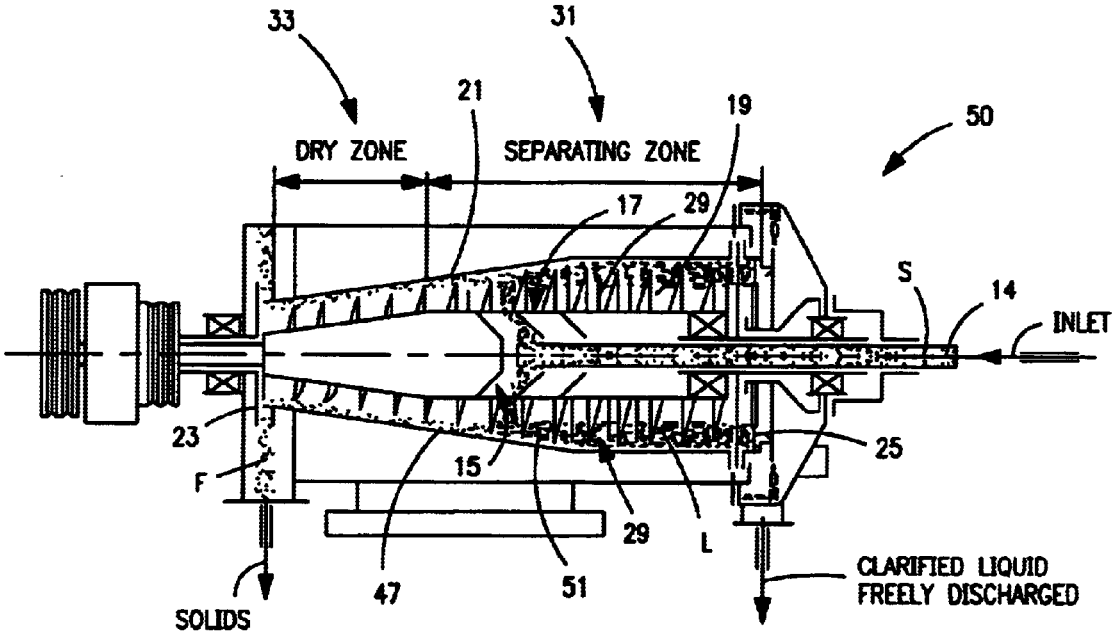
FIG. 3 is a perspective view of a solid-bowl screw-type centrifuge, for a two-phase extraction process, according to the present invention.

In a transition area 43 between the cylindrical section 9 and the conical section 11, a retarder or disk 13 is placed on the screw body 3. This placement was found to be successful particularly in a two-phase separation process separating material into an oil phase and a water/solids phase. Such placement may not be required in a three-phase separation process when separating material into oil, water and solids phases. The two phase separation process is shown in FIG. 3. The three-phase separator process is not shown in the Figures.

The operation of a solid-bowl screw-type centrifuge 50 with screw 1, among other components, is as follows.

As shown in FIG. 3 material S to be centrifuged is fed or guided through a centrally arranged, adjustable inlet tube 14 into an inlet chamber 15. From there material S may go through openings 17 into drum space 19. Drum 21 surrounds the screw 1. Inlet chambers 15 and openings 17, or special distributors, may be arranged toward the rearward end or area 40 of the cylindrical section 3 (see FIG. 1).

In the drum space 19, the material S to be centrifuged is accelerated to a rotational operating speed. Under the effect of the force of gravity, solids particles will be deposited on a wall of drum 21 within a very short time.

The screw 1 may rotate at a slightly lower or higher speed than the drum 21 and may deliver centrifuged solids F toward the conical section 11 out of the drum 21 to the solids discharge 23.

In contrast, liquid L may flow to a larger drum diameter area at the rearward end or area 40 of the drum 21 and may be discharged at overflow 25. In a two-phase extraction process, liquid L may represent the presence of oil. In a three-phase extraction process, liquid L may represent the presence of oil and water.

From a second screw spiral (x+1) to a fifth screw spiral (x+4), the screw 1 has recesses 27 in the screw blade 5.

In the embodiment of FIG. 1, these recesses 27 are constructed such that one or more axial ducts 28 may be formed in an axial direction which may extend, for example, from a second to a fifth screw blade 5. The ducts 28 may also be formed in a zigzag type manner or angularly with respect to a center axis y of the screw. An individual screw spiral x+1 etc. with recesses 27 and blade segments 29 is also conceivable.

In addition, blade segments 29 are arranged in the delivery path 7 formed between the screw spirals x+1, x+2 . . . of the screw blade 5. Blade segments 29 may be constructed as metal strips and which may have a trapezoidal shape which widens radially from an outer circumference of the screw body 3.

Blade segments 29 may be constructed during the cutting-off of material for forming the recesses 27. The blade segments may be placed in the delivery path 7 and may be fastened in the path 7 by welding or by an equivalent means.

The cutting-off of the blade sections or segments 29 may take place such that the screw blade 5 is cut out to the circumference of the screw body 3. However, as an alternative, a residual section 30 of the screw blade 5 may also remain standing at or on the circumference of the screw body 3. If the cutting-out takes place essentially radially with respect to the drum 21 and screw axis y, trapezoidal blade segments 29 are obtained. The screw blades 5 may also be constructed as rectangular or rounded elements or be shaped as tapering or widening elements extending from the screw body 3 radially outward.

By a combination of recesses 27 and blade segments 29 in the delivery path 7, the efficiency of some centrifugal separating processes can surprisingly be increased.

A screw 1 construction with recesses 27 and blade segments 29 has been particularly successful in the field of olive oil extraction. A two-phase separation process in which the oil is separated directly from a solids/water mixture, had been particularly successful in the extraction of olive oil. Such a process is described in European Patent Document EP 557 758. The efficiency of this already excellent process can be increased by using the screw 1 of the present invention, to (see FIGS. 1 and 3):

- separate the oil as a liquid or first phase directly in a two-phase separating process from a second phase mixture of water and solids,
- reduced fruit, such as olives and avocados, are first guided in a solid-bowl screw-type centrifuge 50 through a first portion 31*a* of a separating zone 31 with one or several screw spirals x−1, x, . . . , in which the screw blade 5 has no recesses 27 and in which no blade segments 29 are formed in the delivery path 7,
- then, in a second portion 31*b* of separating zone 31, there is a passing through a screw area in which the recesses 27 are constructed in the screw blade 5 and the blade segments 29 are constructed in the delivery path 7,
- then the solids and the water are conveyed past the retarding disk 13 out of the separating zone 31 into a conically tapering section 11 or dry zone 33 of the screw 1 and out of the centrifuge 50 at discharge 23.

Figure 4:
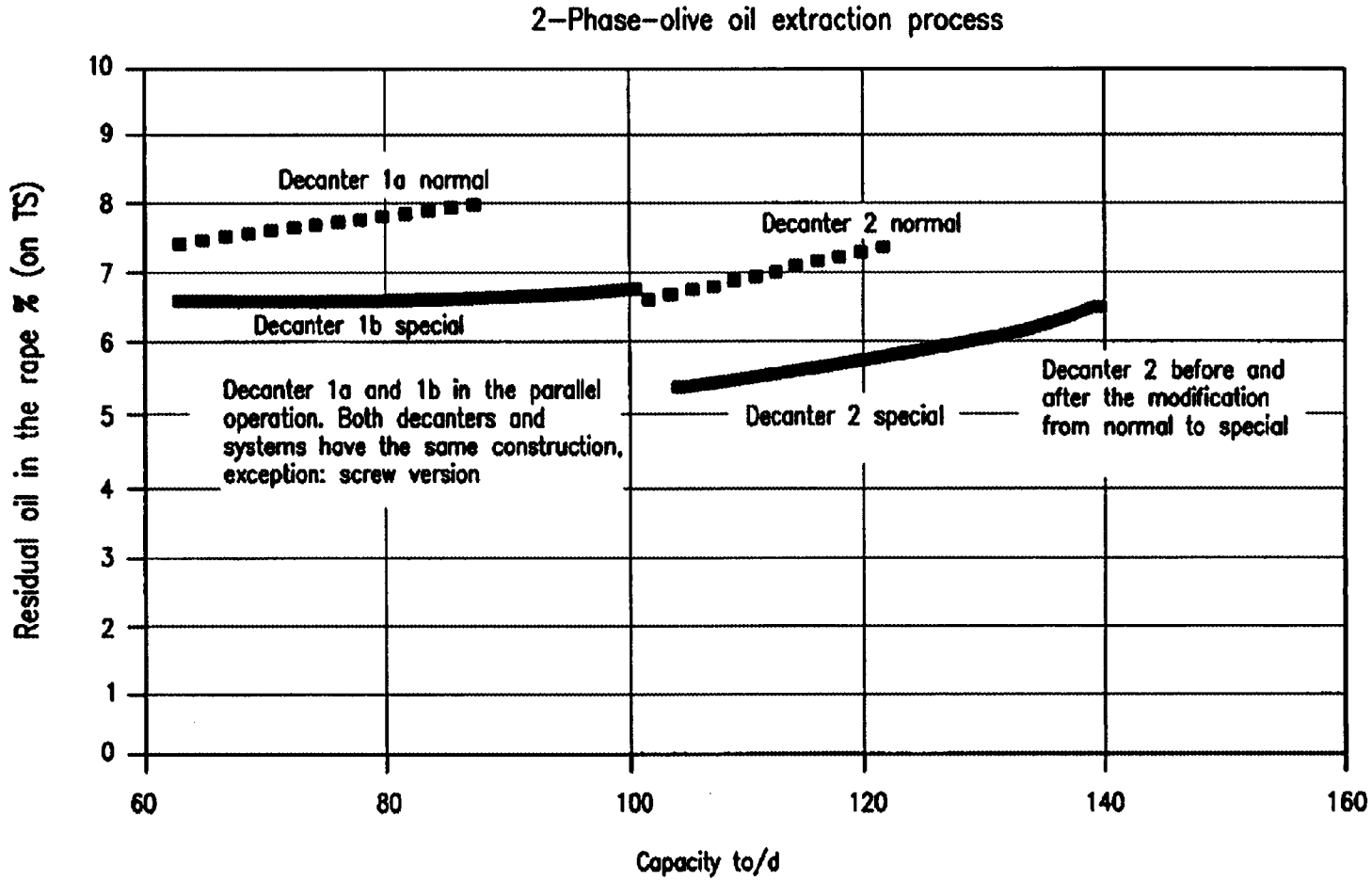
FIG. 4 is a graph representing a comparison, in a two-phase olive oil extraction process, of the improvement of efficiency of oil extraction as a function of throughput using a normal (known) screw versus a screw (special) according to the present invention.
Figure 5:
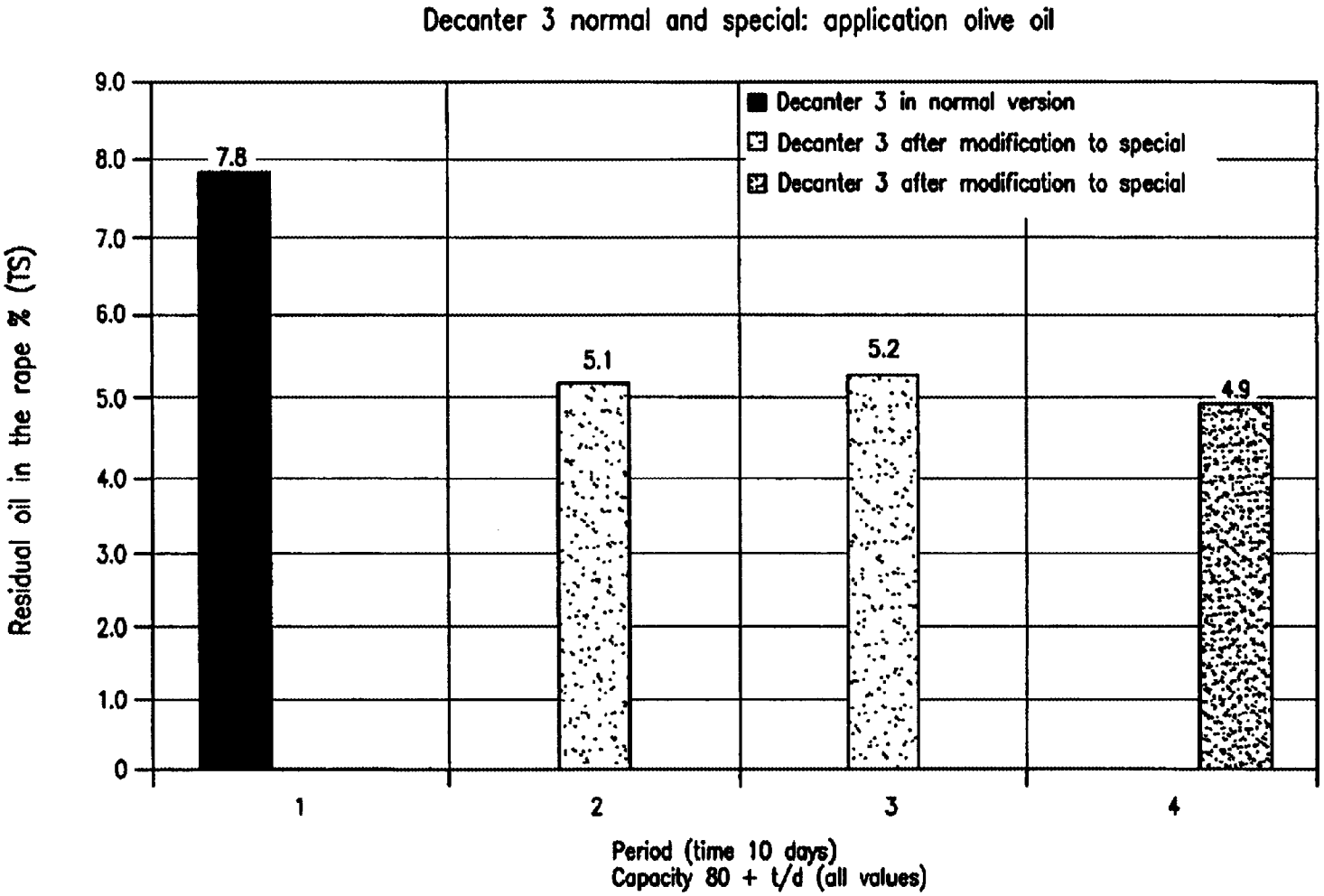
FIG. 5 is a graph comparing the residual oil content in a rape during the extraction of olive oil by means of a solid-bowl screw-type centrifuge in the two-phase separating process using screws according to the invention and using screws according to the prior art.

Comparisons of this two-phase separation process using a conventional or normal screw and the screw 1 of the present invention are illustrated in FIGS. 4 and 5.

FIG. 4 shows comparisons of the improvement of the efficiency of the oil extraction as a function of capacity or throughput (to/d, or tons/day). FIG. 5 also shows that, when extracting olive oil by means of screw 1, according to the present invention, the residual oil content in a rape could be lowered generally in the range of approximately 2% to 3%. The reduction shown in FIG. 5 ranges from 2.6% to 2.9%. The economic efficiency of the oil extraction is therefore again considerably increased with respect to the already excellent prior art result of the two-phase separation of a) oil and b) water/solids. The modification or exchange of the conventional (prior art) screw by the screw 1, according to the present invention, will therefore be beneficial within a short time.

Figure 6A:
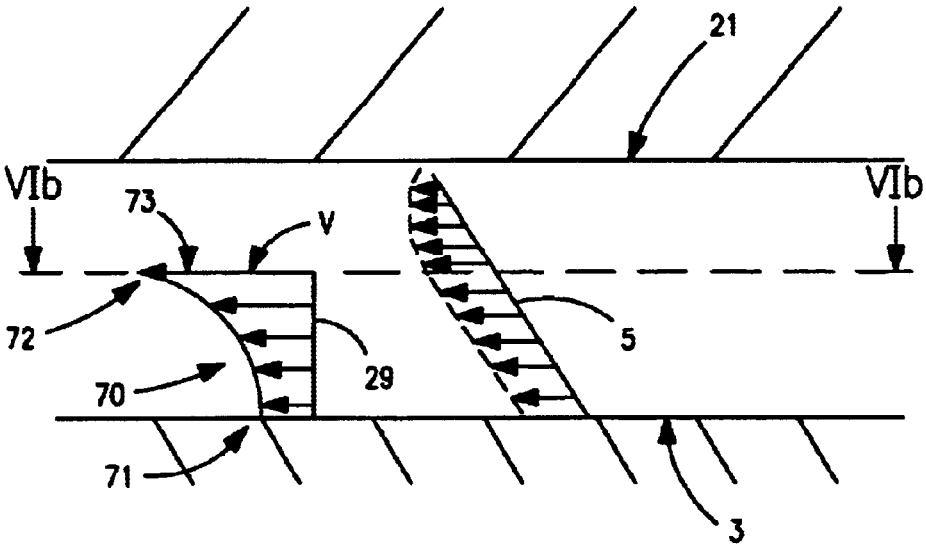
FIG. 6*a* is a sectional view, along line VIa—VIa of FIG. 6*b*, of speed profiles in an area of a screw blade and blade segment, according to the present invention.
Figure 6B:
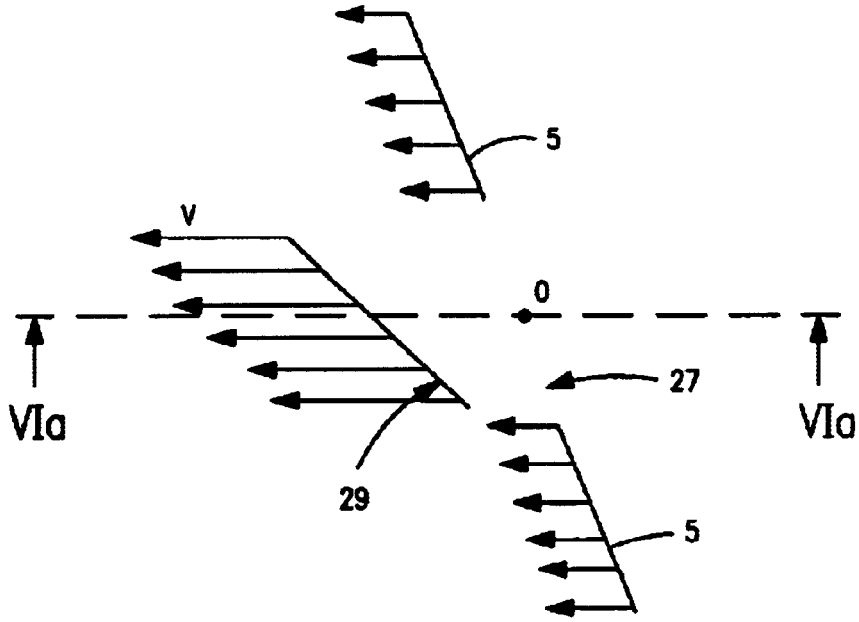
FIG. 6*b* is a sectional view, along the line VIb—VIb of FIG. 6*a*, of speed profiles in a screw spiral in an area of recesses, screw blades and blade segments for a screw, according to the present invention.

FIGS. 6*a, b* show speed profiles in a screw spiral x, x+1 . . . in the area of the recesses 27 and blade segments 29. FIGS. 6*a* and 6*b* represent two views, 90° from each other, of the recesses 27, blade segments 29 and screw blades 5. FIG. 6*a* shows that "in the shadow" 70 of the blade segment 29, the speed (shown as an arrow or arrows ←) of the particles increases from the inside 71 toward the outside 72 of the blade segment 29. At the upper edge 73 of the blade segment 29, the maximal value V is reached which, according to FIG. 6*b*, is essentially constant at the upper blade segment edge 73. At point O in FIG. 6*b*, the speed or velocity of the particles approaches its minimum, which could be zero.

Different dimensions as well as alignments and arrangements of the recesses 27 and of the blade segments 29 were found to be particularly successful in practice. By the variation of these parameters, the mixing effects between the screw spirals x, x+1 . . . can also be varied, which has a direct influence on the efficiency of the separating process. These parameters are described below with reference to FIGS. 1, 2*a* and 2*b* as is the preferred position of the recesses 27 and the blade segments 29.

For discussion, the screw 1, as shown in FIG. 1, is viewed from the rearward area 40 of cylindrical section 9 toward the front area 45 of the conical section 11. The screw 1 has several screw spirals, for example x−1, x, in first portion 31*a*, and screw blades 5 are constructed to be continuous or free of recesses 27. Preferably, one or more screw spirals x−1, x . . . are constructed to be continuous. In this area 31*a*, no blade segments 29 are provided in the delivery path 7.

This first portion 31*a* of the separation zone 31 zone is followed by a second portion 31*b* where, for example, several screw spirals x+1, x+2, . . . x+4 are provided with recesses 27 and in whose spaces or in whose delivery paths 7, the blade segments 29 are in each case constructed or erected. The blade segments 29 may be welded on the screw body 3 or attached by other equivalent means.

The cylindrical section 9 extends maximally to a beginning of the conical section 11 of the screw 1. In the transition area 43, between the cylindrical section 9 and the conical section 11, the retarding disk 13 is arranged. In the conical section 11, the screw 1 may be constructed to be free of recesses 27 and no additional blade segments 29 may be arranged in the delivery path 7.

For each screw spiral x+1, x+2 . . . in the cylindrical section 9, there may be approximately 2–6, and preferably 4, recesses 27.

Correspondingly, for each screw spiral x+1, x+2 . . . in the delivery path 7, there may be approximately 2 to 6, and preferably 4, blade segments 29.

The blade segments 29 are preferably distributed uniformly on the circumference of the screw body 3 but may be distributed non-uniformly.

Figure 2A:
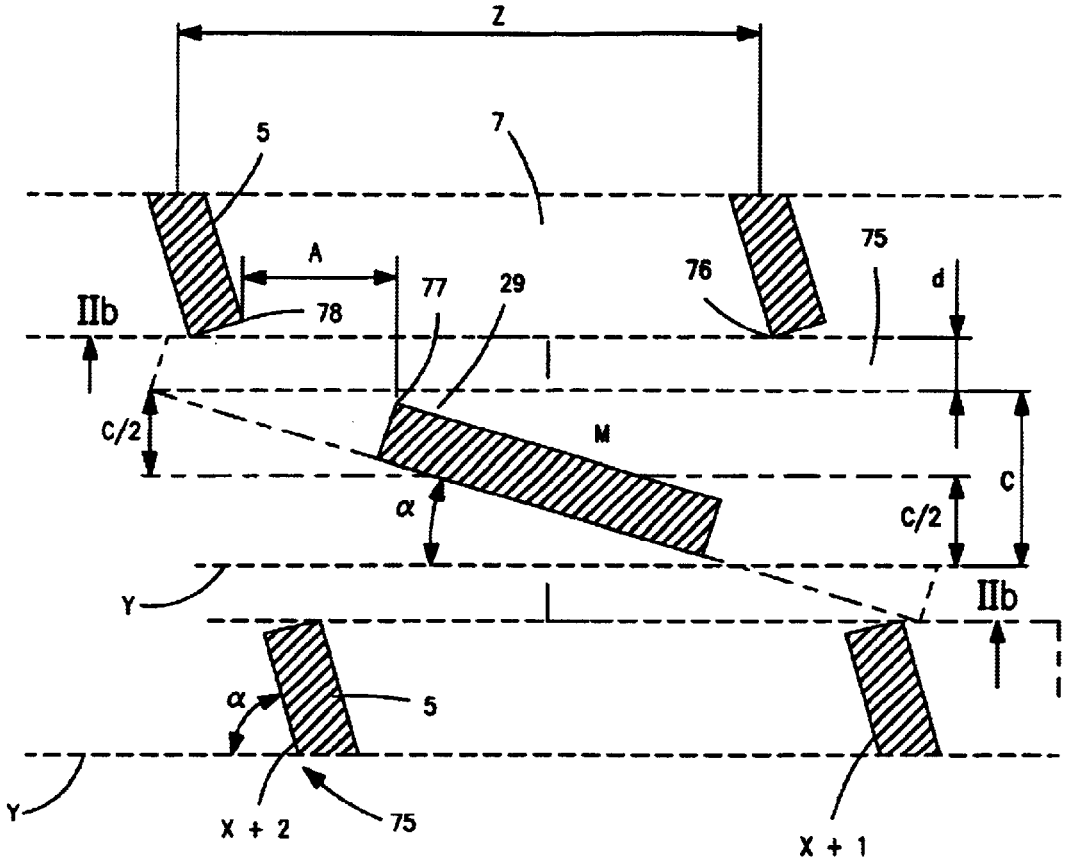
FIG. 2*a* is a top view of a section of a screw, according to the present invention.

Relative to the center axis or the axis of symmetry y of the screw 1, the screw spirals x, x+1 . . . are each arranged at an angle or form an angle $\alpha$ with the center axis y (see FIG. 2*a*). The magnitude of the angle $\alpha$ (measured at a lower edge 75 of the screw blade 5) is approximately between 60 and 85°, and preferably approximately 75 to 80°.

In contrast, as shown in FIG. 2*a*, the blade segments 29 enclose an angle $\delta$ with the center axis or axis of symmetry y, which may be smaller than angle $\alpha$. The angle $\delta$ is approximately between 40 and 70°, and preferably approximately 50 to 55°. It is recommended to align, in the last screw spiral, for instance, x+5 . . . of the cylindrical section 9 before the retarding disk 13, the blade segments 29 essentially parallel to the screw blade 5. The maximal differential between angles $\alpha$ and $\delta$, may be preferably approximately 10 to 11°.

The recesses 27 each have an area and the sum of those areas is a total recess area. The screw spirals x, x+1 . . . each have a surface area and the sum of those areas is a total screw spiral surface area. The total recess area of the recesses 27 may amount to approximately 25–60% of the total screw spiral surface area, and preferably 40–50%.

As shown in FIG. 2*a*, angle $\delta$ may be defined or determined such that a distance d (viewed as an axial extension of edges) between a blade segment edge 76 and a recess edge 77 is approximately 0 to 5 mm, and preferably approximately 2 to 3 mm. The distance d viewed from the screw body 3 becomes smaller with an increasing height of the blade segment. In the case of a trapezoidal shape of the blade segments 29, the size of any distances "d" as measured from the screw body 3, varies radially away from axis y and screw body 3 toward an outside position nearer a wall (not shown) of the drum 21. Distance "d" becomes, for example, larger toward the outside position.

Furthermore, angle may be defined or determined such that a distance A (see FIGS. 2*a*, 2*b*) viewed as an orthogonal extension of edges, between a longitudinal edge 78 of the screw blade 5 and the edge 77 of the recess 27 amounts to approximately 0 to 28%, and preferably 15 to 25%, of a distance z (See FIG. 2*a*) between an adjacent pair of screw spirals, for example x+2 and x+3, preferably viewed at the low end of the screw (inside), as a function of the shape.

According to an embodiment of the present invention, the blade segment 29 may be arranged in the delivery path 7 such that center axis M (see FIG. 2*a*) is situated precisely in the center of the delivery path 7, as well as preferably also in the center of a connection line C, having segments C/2, of the apothem of the recesses 27 at a crossing point of opposite recess edges (not defined).

As an alternative, it is also possible to shift the center axis or center point M of the blade segments 29 with respect to the preferable position as stated above.

A height h (see FIG. 2*b*) of the blade segments 29 (measured from the outer circumference of the screw body 3) is particularly decisive for the efficiency of the present invention.

According to the present invention, the height h of the blade segments 29 may be selected such that the segments 29 extend into an area where solids are present, or solids area 47, during centrifugal separation. Correspondingly, the screw blades 5 should have recesses 27 which radially project at least above the area of the solids area 47.

For example, in a case of centrifugal separation, solids are deposited relatively far to an outside or solids area 47 in the drum 21. If the blade segments or paddles 29 do not at least extend into this solids area 47, their efficiency remains low. A mixing effect of the recesses 27 and of the blade segments 29 in this solids 47 area clearly increases the efficiency of the centrifugal separation during the extraction of oil.

Figure 2B:
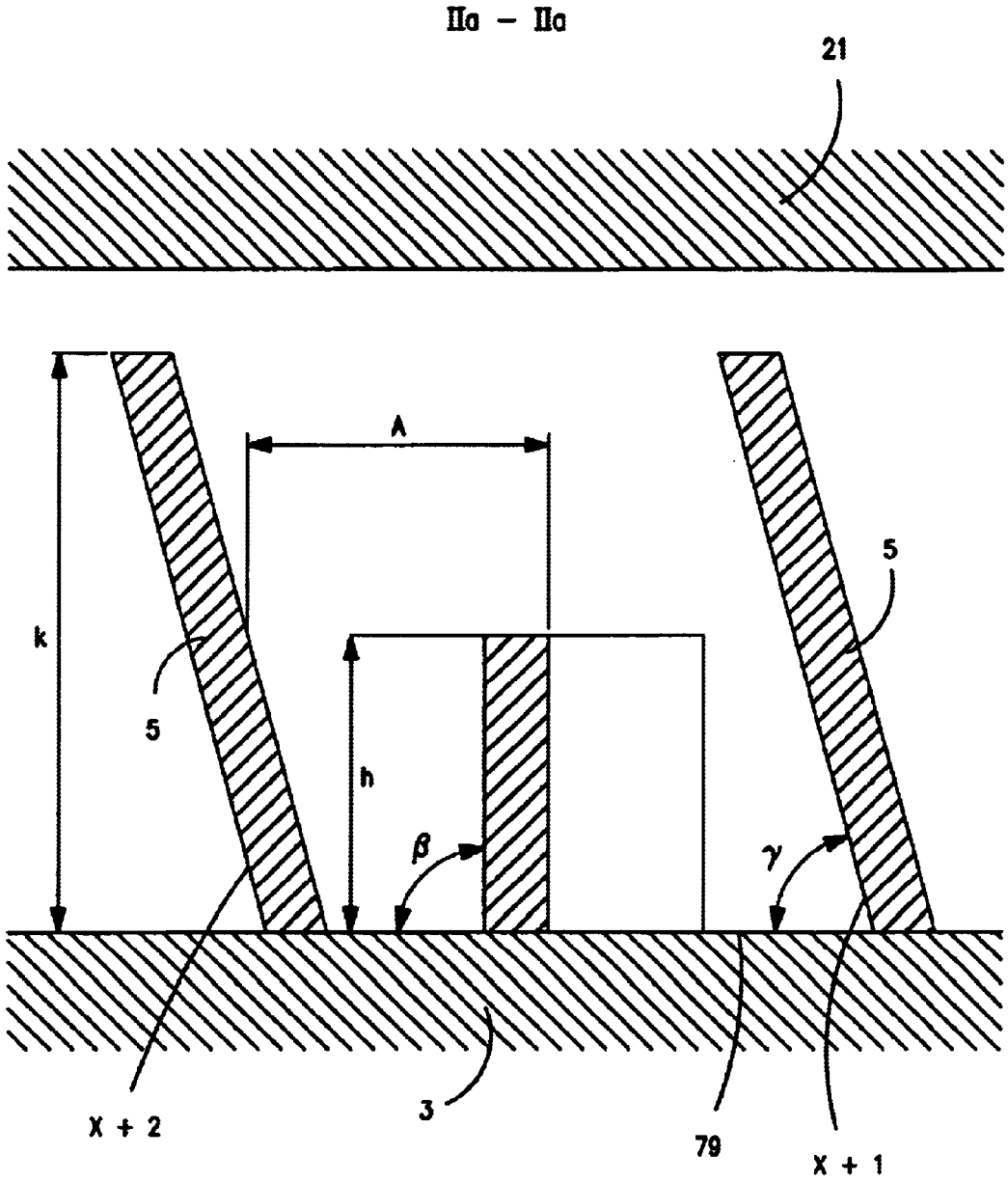
FIG. 2*b* is a sectional view along Line IIb—IIb of FIG. 2*a*.

In practice, the height h (see FIG. 2*b*) is selected to be approximately 0–30% lower than a screw blade height k. Thus, a radial course (not shown) of the recesses 27, or, in effect, height h, amounts to approximately 70–100% of the height k. In addition, the screw blade 5 encloses an angle $\gamma$ with a circumferential wall 79 of the screw body 3, as shown in FIG. 2*b*. This angle $\gamma$ is preferably smaller than an angle $\eta$ which the blade segment 29 forms with the screw body 3.

Although the present invention has been described and illustrated in detail, it is to be clearly understood that this is done by way of illustration and example only and is not to be taken by way of limitation. The spirit and scope of the present invention are to be limited only by the terms of the appended claims.

What is claimed is:

1. A screw for a solid-bowl screw-type centrifuge, comprising:

a screw body;

at least one screw blade surrounding the screw body several times and forming several screw spirals;

a delivery path formed between the screw spirals for conveying material to be centrifuged;

blade segments arranged in the delivery path between adjacent screw spirals;

recesses in the at least one screw blade constructed such that the material to be centrifuged can flow through between adjacent screw spirals;

wherein a cylindrical section of the screw body includes a first portion having at least one screw spiral without recesses and blade segments, and a second portion having at least one screw spiral with recesses and blade segments; and wherein the second portion of the cylindrical section with the recesses and the blade segments extends to a conically tapering section of the screw body but not into it.

2. The screw according to claim 1, wherein the cylindrical section is in a rearward area of the screw body and the conically tapering section is in an adjoining forward area of the screw body, the conically tapering section tapering one or more of essentially uniformly or non-uniformly, and the recesses and the blade segments being constructed only in the cylindrical section.

3. The screw according to claim 2, wherein the screw body has a retarding disk located in a transition area between the cylindrical section and the conically tapering section.

4. The screw according to claim 2, further including an inlet located adjacent the rearward area of the cylindrical section.

5. The screw according to claim 1, wherein oil drainage ducts are formed in a first screw spiral.

6. The screw according to claim 1, wherein the recesses are constructed on the screw such that at least one duct is formed only in the second portion of the cylindrical section and extends over several screw spirals.

7. The screw according to claim 6, wherein the at least one duct is formed axially with respect to a center axis of the screw.

8. The screw according to claim 6, wherein the at least one duct is formed angularly with respect to a center axis of the screw.

9. The screw according to claim 1, wherein the blade segments are constructed such that, when material is cut off for forming the recesses, the cut off material is placed as blade segments in the delivery path and fastened in the path.

10. The screw according to claim 1, wherein the recesses have a residual section of the screw blade on a circumference of the screw body.

11. The screw according to claim 1, wherein approximately two to six recesses are constructed for each screw spiral.

12. The screw according to claim 1, wherein four recesses are constructed for each screw spiral.

13. The screw according to claim 1, wherein approximately two to six blade segments are provided for each screw spiral in the delivery path.

14. The screw according to claim 1, wherein four blade segments are provided for each screw spiral in the delivery path.

15. The screw according to claim 1, wherein relative to one or more screw spirals, the blade segments are uniformly distributed on a circumference of the screw body.

16. The screw according to claim 1, wherein relative to one or more screw spirals, the blade segments are non-uniformly distributed on a circumference of the screw body.

17. The screw according to claim 1, wherein the recesses each have an area and the screw spirals each have a surface area, and the sum of the recess areas amounts to approximately 25 to 60% of a sum of the screw spiral surface areas.

18. The screw according to claim 17, wherein the sum of the areas of the recesses amounts to approximately 40 to 50% of the sum of the screw spiral surface areas.

19. The screw according to claim 1, wherein a height h of the blade segments, viewed from a circumference of the screw body, is selected such that the blade segments extend into a solids area during centrifugal separation.

20. The screw according to claim 19, wherein the at least one screw blade has a height k and the height h of the blade segments is approximately 0–30% less than height k.

21. The screw according to claim 20, wherein a radial course of the recesses amounts to approximately 70–100% of the height k of the screw blade.

22. The screw according to claim 1, wherein the recesses in the at least one screw blade are constructed such that they radially project at least into a solids area.

23. The screw according to claim 1, wherein the blade segments are constructed as rectangular metal plates.

24. The screw according to claim 1, wherein the blade segments are constructed as one of rectangular, trapezoidal, rounded and widening or tapering elements extending from the screw body radially outward.

25. A screw for a solid-bowl screw-type centrifuge, comprising:

a screw body;

at least one screw blade surrounding the screw body several times and forming several screw spirals;

a delivery path formed between the screw spirals for conveying material to be centrifuged;

blade segments arranged in the delivery path between adjacent screw spirals;

recesses in the at least one screw blade constructed such that the material to be centrifuged can flow through between adjacent screw spirals;

wherein a cylindrical section is in a rearward area of the screw body and a conical section is in an adjoining forward area of the screw body, the conical section tapering one or more of essentially uniformly or non-uniformly, and the recesses and the blade segments being constructed only in the cylindrical section; and wherein the screw body has a retarding disk located on a transition area between the cylindrical section and the conical section; and wherein the screw spirals are each arranged at an angle $\alpha$ with a center axis of the screw body, the magnitude of the angle $\alpha$ being between approximately 60 and 85° and the blade segments each enclose an angle $\delta$ with the center axis, the magnitude of angle $\delta$ being smaller than that of angle $\alpha$.

26. The screw according to claim 25, wherein the magnitude of angle $\delta$ is between approximately 40 and 70°.

27. The screw according to claim 25, wherein the magnitude of angle $\delta$ is approximately 45 to 60°.

28. The screw according to claim 25, wherein in a last screw spiral before the retarding disk, the blade segments are aligned essentially parallel to the at least one screw blade and a maximal differential between angles $\alpha$ and $\delta$ is approximately 10 to 11°.

29. The screw according to claim 25, wherein the angle $\delta$ is determined such that a distance d, viewed as an axial extension of edges, between a blade segment edge and a recess edge is approximately 0 to 5 mm.

30. The screw according to claim 29, wherein the distance d, viewed from the screw body, becomes smaller with an increasing height of the blade segment.

31. The screw according to claim 25, wherein the size of angle $\delta$ is determined such that a distance A, viewed as an orthogonal extension of edges, between a longitudinal edge of the screw blade and a recess edge amounts to approximately 0 to 28% of the distance between an adjacent pair of screw spirals.

32. The screw according to claim 25, wherein the magnitude of angle $\alpha$ is approximately 75 to 80°.

33. A screw for a solid-bowl screw-type centrifuge, comprising:

a screw body;

at least one screw blade surrounding the screw body several times and forming several screw spirals;

a delivery path formed between the screw spirals for conveying material to be centrifuged;

blade segments arranged in the delivery path between adjacent screw spirals;

recesses in the at least one screw blade constructed such that the material to be centrifuged can flow through between adjacent screw spirals;

wherein the delivery path has a center and each blade segment is arranged in the delivery path such that its center axis M is situated precisely in the center of the delivery path as well as in a center of a connection line of the apothem of the recesses; and wherein the center axis of each blade segment is shifted with respect to one of the center of the delivery path and the center of the connection line of the apothem of the recess.

34. A screw for a solid-bowl screw-type centrifuge, comprising:

a screw body;

at least one screw blade surrounding the screw body several times and forming several screw spirals;

a delivery path formed between the screw spirals for conveying material to be centrifuged;

blade segments arranged in the delivery path between adjacent screw spirals;

recesses in the at least one screw blade constructed such that the material to be centrifuged can flow through between adjacent screw spirals; and wherein the at least one screw blade encloses an angle $\gamma$ with a circumferential wall of the screw body, which angle $\gamma$ is smaller than an angle $\beta$ which the blade segment forms with the screw body.

35. A method of extracting oil from fruit or seeds, with the oil being directly extracted as a liquid phase, in a two-phase separating process, from a mixed phase of water and solids, the method steps comprising:

feeding reduced-fruit material to be centrifuged into a centrifuge having a separating zone and a dry zone;

operating the centrifuge;

guiding the reduced-fruit material through the centrifuge into a first portion of the separating zone, the separating zone having at least one screw blade with one or more screw spirals, the at least one screw blade having no recesses, and there being no blade segments in a delivery path between the one or more screw spirals;

passing the material into a second portion of the separating zone having at least one screw blade with one or more screw spirals, the at least one screw blade having at least one recess and there being at least one blade segment in the delivery path between the one or more screw spirals;

conveying the water and solids phase out of the separating zone, past a retarding disk, into the dry zone and out of the centrifuge; and conveying the oil phase in an opposite direction of the water and solids phase and out of the centrifuge.

36. The method according to claim 35, wherein the oil, as a distinct phase in an oil separation area, is generally recognized approximately in the range of 20–30 mm outside or away from a screw body.

37. A method of extracting oil from fruit or seeds, with the oil, extracted as a liquid phase, in a three-phase separating process, from a water phase comprising water, and a solids phase comprising solids, the method steps comprising:

feeding reduced-fruit material to be centrifuged into a centrifuge having a separating zone and a dry zone;

operating the centrifuge;

guiding the reduced-fruit material through the centrifuge into a first portion of the separating zone, the separating zone having at least one screw blade with one or more screw spirals, the at least one screw blade having no recesses, and there being no blade segments in a delivery path between the one or more screw spirals;

passing the material into a second portion of the separating zone having at least one screw blade with one or more screw spirals, the at least one screw blade having at least one recess and there being at least one blade segment in the delivery path between the one or more screw spirals; and conveying the water phase, solids phase and oil phase essentially separately out of the centrifuge.

38. The method according to claim 37, wherein the oil, as a distinct phase in an oil separation area, is generally recognized approximately in the range of 20–30 mm outside or away from a screw body.

39. A screw for a solid-bowl screw-type centrifuge, comprising:

a screw body;

at least one screw blade surrounding the screw body several times and forming several screw spirals;

a delivery path formed between the screw spirals for conveying material to be centrifuged;

blade segments arranged in the delivery path between adjacent screw spirals;

recesses in the at least one screw blade constructed such that the material to be centrifuged can flow through between adjacent screw spirals;

wherein a cylindrical section of the screw body includes a first portion having at least one screw spiral without recesses and blade segments, and a second portion having at least one screw spiral with recesses and blade segments;

wherein the recesses are constructed on the screw such that at least one duct is formed only in the second portion of the cylindrical section and extends over several screw spirals; and wherein the at least one duct is formed in a zigzag-type manner with respect to a center axis of the screw.

* * * * *